United States Patent [19]

Boer

[11] 3,999,291

[45] Dec. 28, 1976

[54] LOCKING DEVICE FOR SHAVING HEAD

[75] Inventor: Melle Boer, Drachten, Netherlands

[73] Assignee: U.S. Philips Corporation, New York, N.Y.

[22] Filed: May 8, 1975

[21] Appl. No.: 575,457

[30] Foreign Application Priority Data

May 17, 1974 Netherlands ..... 7406635

[52] U.S. Cl. ..... 30/43.92; 292/166; 292/DIG. 72

[51] Int. Cl.[2] ..... B26B 19/04; E05C 1/14

[58] Field of Search ..... 292/166, DIG. 72; 403/322, 324, 325, 327, 328, 330, 16; 30/43, 43.1, 43.92

[56] References Cited

UNITED STATES PATENTS

| | | | |
|---|---|---|---|
| 1,330,693 | 2/1920 | Fisher | 292/DIG. 72 |
| 1,593,011 | 7/1926 | Bourgon | 292/DIG. 72 |
| 2,998,275 | 8/1961 | Nallinger | 292/166 X |
| 3,290,781 | 12/1966 | Kratz | 30/43.1 X |

*Primary Examiner*—Gary L. Smith
*Attorney, Agent, or Firm*—Frank R. Trifari

[57] ABSTRACT

An electric dry-shaving apparatus provided with a locking device for releasably securing the shaving head to the housing, the locking device including a spring-biased pin in a recess, with a depressable button for releasing said device.

4 Claims, 3 Drawing Figures

LOCKING DEVICE FOR SHAVING HEAD

BACKGROUND OF THE INVENTION

The invention relates to an electric dry-shaving apparatus which is provided with at least one locking device for locking the detachable shaving head on the housing, the locking device including a resiliently depressable locking member and an actuating member.

SUMMARY OF THE INVENTION

For locking shaving heads many constructions are known. It is an object of the invention to provide a construction which can be operated very simply, and the invention is characterized in that the actuating member is provided with a latching device for latching the actuating member in a position in which the shaving head is detachable, the latching device being provided with an actuating element which effects unlatching when the shaving head is fitted onto the apparatus.

The advantage of this construction is that in the latched position of the actuating member said member need not be retained for removing the shaving head from the housing. When the shaving head is pressed into its mounted position, only slight pressures must be overcome, yet providing satisfactory locking.

The locking device and the latching device may be accommodated both in the housing and in the shaving head. Several locking devices with latching devices are possible. In one embodiment the locking device and the latching device are accommodated in the housing, and the actuating member takes the form of a push-button, which via a lever is coupled to the locking member the latching device comprises a pin, which is accommodated in the push-button and which in a direction transverse to the direction of movement of the push-button is depressable against a spring force and which pin in the depressed condition of the push-button engages with a wall portion of the housing. As a result the push-button is blocked and the shaving head is completely unlocked.

Another embodiment is characterized in that the actuating element consists of a pin which is provided with a bevelled surface, which cooperates with a correspondingly bevelled surface of the spring-loaded pin and which pin is movably disposed in line with the spring-loaded pin.

The invention will be described in more detail with reference to an embodiment shown in the drawings.

DETAILED DESCRIPTION OF THE PREFERRED EMBODIMENT

Figure 1:
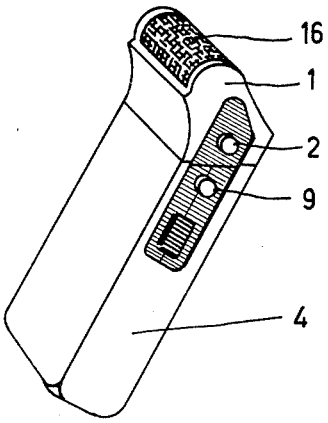
FIG. 1 shows the shaving apparatus in perspective.
Figure 2:
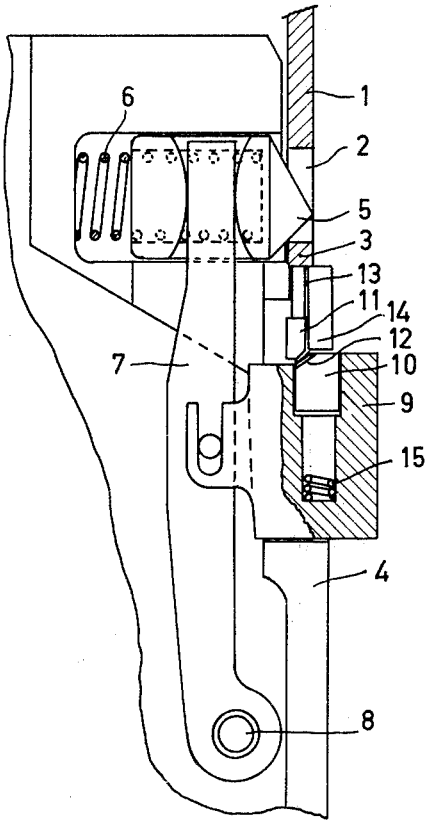
FIG. 2 is a cross-section of the locking device and the latching device in the locked condition of the shaving head.
Figure 3:
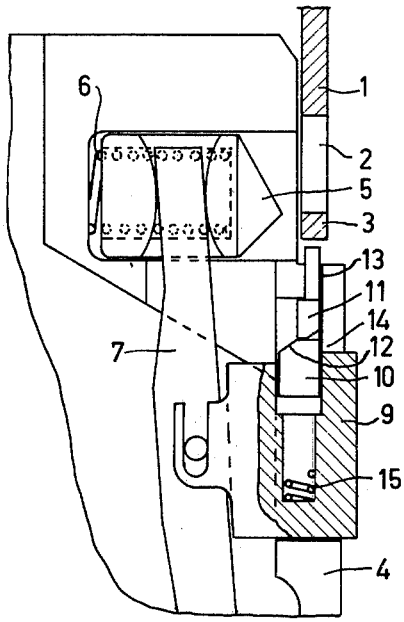
FIG. 3 is a cross-section of the locking device and the latching device at the instant that the shaving head is unlocked and the push-button is latched.

At either side of the housing 4 a locking device with latching device is disposed, only one of which is visible in FIG. 1. In the housing 4 a pin 5 is disposed, which via a lever 7 is coupled to a push-button 9. The pin 5 is pressed into a recess 2 of the shaving head 1 by a spring 6 and thus retains the shaving head in such a way that the external shaving element 16 can suitably co-operate with the internal shaving element, not shown. The pin 5 has a slot 5*a* which the lever can slide. The lever 7, which is pivoted in point 8, may for example be fork-shaped. The latching device consists of a spring-loaded rod 10 and a pin 11. The rod and the pin are provided with a bevelled face 12, thus providing a satisfactory mutual cooperation. Different manners of cooperation are also possible, for example via a roller. The rod 10 is accommodated in the push-button 9 and is depressable in a direction transverse to the direction of movement of the push-button against spring force. The pin 11 is movably disposed in line with the rod 10 and can slide in an opening 13 in the wall of the housing 4. Said opening 13 faces the underside 3 of the shaving head 1. In the locked condition of the shaving head the rod 10 of the latching device is retained by wall portion 14 of the housing.

During depression of push-button 9 the pin 5 of the locking device is withdrawn from the recess 2 of the shaving head and via the bevelled faces 12 the rod 10 of the latching device pushes the pin 11 and thus the shaving head upwards. In the fully depressed condition of the push-button 9 the rod 10 is pressed behind the wall portion 14 by the spring 15 and thus latches the push-button. Moreover, the rod 10 via the pin 11 presses the shaving head further upwards. The pin 11 now partly projects from the housing.

When the shaving head is fitted on the housing, the underside 3 of the shaving head will press the pin 11 downwards, so that the push-button 9 is fully released. The spring 6 presses the pin 5 again into the recess 2 of the shaving head, thus restoring the locked condition. The lever 7 and the push-button 9 assume their original position.

What is claimed is:

1. In an electric shaver including a housing and a shaving head mounted on said housing and removable in a first axial direction, the improvement in combination therewith of locking means for releasably locking said shaving head onto said housing and for dis-engaging said shaving head from said housing comprising: a pin and first spring means carried by said housing and movable in a second axial direction transversely of said first axis, said first spring means biasing the pin to move from its release position to its locking position, said shaving head having a recess receiving said pin in the locking position thereof thereby locking said shaving head onto said housing, a push-button carried by said housing and movable similarly as said pin, said push-button depressible to its release position for driving said pin to its release position thereby releasing said shaving head, said locking means further comprising a rod and second spring means carried by said button said second spring means biasing said rod to move in said first axial direction from its recessed position to its extended position, said housing having a wall portion adjacent said rod, said rod in its extended position urging said shaving head axially off said housing, and engaging said wall portion which prevents said rod, the button carrying the rod, and the pin from movement in said second axial direction to the locking positions thereof, said shaving head when remounted on said housing driving said rod axially back to its recessed position, thus releasing said rod, button and pin to return to their locking positions, said pin thus engaging said recess in said shaving head.

2. Apparatus according to claim 1 wherein said locking means further comprises a lever having one end pivotally mounted on said housing, a remote end engaging said pin, and an intermediate part engaged by said push-button.

3. Apparatus according to claim 2 wherein said pin includes a slot and said remote end of the lever is situated in said slot.

4. Apparatus according to claim 1 wherein said locking means further comprises a second pin carried by said housing and movable in said first axial direction, said second pin being axially intermediate said rod and said shaving head, said second pin and said rod having adjacent ends with adjacent bevelled surfaces, wherein upon movement of said button and rod in said second axial direction, said bevelled surface of the rod engaging said bevelled surface of said second pin causes said second pin to move in said first axial direction, prior to said spring-biased rod moving from its recessed position to its extended position.

* * * * *